United States Patent [19]

Kaneda

[11] Patent Number: 4,484,107

[45] Date of Patent: Nov. 20, 1984

[54] DISCHARGE LAMP LIGHTING DEVICE AND SYSTEM

[75] Inventor: Isao Kaneda, Otsu, Japan

[73] Assignee: NEC Home Electronics, Ltd., Osaka, Japan

[21] Appl. No.: 349,709

[22] Filed: Feb. 18, 1982

[30] Foreign Application Priority Data

Jul. 13, 1981 [JP] Japan ..... 56-109632
Jul. 13, 1981 [JP] Japan ..... 56-109633

[51] Int. Cl.[3] ..... H05B 37/02

[52] U.S. Cl. ..... 315/176; 315/170; 315/172; 315/174; 315/244; 331/75

[58] Field of Search ..... 315/175, 176, 170, 200 R, 315/224, DIG. 2, 172, 174, 244; 331/75; 363/157

[56] References Cited

U.S. PATENT DOCUMENTS 1,885,728 11/1932 Keith ..... 363/157
3,997,814 12/1976 Toho ..... 315/200 R
4,362,971 12/1982 Sloan, Jr. ..... 315/176
4,378,513 3/1983 Yoshikawa et al. ..... 315/176

FOREIGN PATENT DOCUMENTS 2755561 6/1978 Fed. Rep. of Germany ..... 315/176
5261379 5/1977 Japan ..... 315/176

*Primary Examiner*—David K. Moore
*Assistant Examiner*—Vincent DeLuca
*Attorney, Agent, or Firm*—W. G. Fasse; D. H. Kane, Jr.

[57] ABSTRACT

In a discharge lamp lighting system comprising a DC or low frequency (LF) AC main source and a high frequency (HF) source, a high frequency component from the HF source and low frequency component from the main source are supplied in an overlapping manner to the discharge lamp. The HF source of the lighting device is energized by input current from the main source for producing a high frequency current. In addition, the lighting device for the discharge lamp include in combination an HF blocking circuit, an HF passing circuit and/or a matching circuit for the HF source to supply effectively a high frequency component to the discharge lamp, as well as a low frequency component from the main source. In a preferred embodiment, the discharge lamp lighting device includes an HF oscillating circuit for converting an LF component into an HF component and for supplying its intermittent output to the discharge lamp to reignite the discharge lamp at the initial part in each half cycle of the AC source, and to keep the lamp continuously lit.

16 Claims, 18 Drawing Figures

DISCHARGE LAMP LIGHTING DEVICE AND SYSTEM

BACKGROUND OF THE INVENTION

The present invention relates to a discharge lamp lighting system for improving the light emission efficiency, particularly to a discharge lamp lighting circuit which supplies a low frequency (LF) component and a high frequency (HF) component to a discharge lamp in every half cycle of the ignited system.

In conventional discharge lamp lighting devices, the lamp is initially ignited by the use of a glow starter or an electronic starter. After the lamp is initially ignited, the starter stops its operation, and the lamp lighting is maintained by a reignition in each half cycle of the AC source voltage. Such devices have been disclosed, for example, in U.S. Pat. Nos. 3,665,243, 3,753,037 and 3,866,088. FIG. 1 shows such a conventional discharge lamp lighting device using an electronic starter, which comprises a choke 12 connected in series with an AC source 10, a discharge lamp 13 and an oscillating circuit 14 connected in parallel with the lamp. The oscillating circuit 14 as a starter comprises an oscillation capacitor 15, and a series circuit of a nonlinear inductor 16 and a two-terminal bidirectional thyristor 17 as a current controlled nonlinear resistor element, wherein the series circuit is connected across the capacitor, and the nonlinear inductor 16 is a step-up voltage inductor having an equivalent capacitance to generate a backswing voltage.

In the above lighting device, since the oscillating circuit 14 has a low impedance characteristic relative to the LF component during its oscillating operation, the oscillating circuit 14 is short-circuited for the LF component. Therefore, the HF component generated by the circuit 14 is applied only to both ends of the lamp. Accordingly, it is difficult to shift the glow discharge into an arc discharge condition for the LF component so as to start the lamp operation. In other words, the above lighting circuit has a significant defect in that it requires a very high oscillation voltage for the initial ignition of the lamp. Moreover, the ratio of the source voltage E to the lamp voltage $V_T$ of the lamp 13 must be selected to be much higher to satisfy the following condition ($E \geqq 2 V_T$). Accordingly, the choke 12 which supports a large balance voltage between the source voltage and the lamp voltage, has to be large thereby decreasing the power efficiency due to an increased ballast loss. Nowadays, an efficiency improvement in lamp lighting devices is very important in the lighting technology for saving resources and energy.

Thus, an improved every half cycle ignited system has been proposed. For instance, U.S. Pat. Nos. 4,079,292 and 4,238,078 disclose the use of a HF high voltage output generated by an intermittent oscillation at every half cycle of the source voltage for the reignition of the lamp. A typical discharge lamp lighting device of this system is indicated shown in FIG. 2, which comprises a choke 12 connected in series with an AC source 10. A discharge lamp 13 is provided with filaments 11, and an intermittent oscillating circuit 18 is connected in parallel with the lamp 13 to generate an HF high voltage output. The circuit 18 comprises an oscillation capacitor 15 connected in parallel with the lamp 13 at the source side, and a series circuit including an intermittent oscillation capacitor 19, a nonlinear inductor 16 and a thyristor 17. The series circuit is connected in parallel with the lamp 13 at the non-source side. The intermittent oscillating circuit 18 comprises the filaments 11, the intermittent oscillation capacitor 19, and the oscillating circuit 14 of FIG. 1. For such a lamp lighting device, the source voltage E can be selected to be almost equal to the lamp voltage $V_T$ ($E \div V_T$), so that the choke 12 can be remarkably diminished as compared with that of FIG. 1.

In the operation, the AC source 10 is connected to supply the source voltage to both the lamp 13 and the circuit 18 through the choke 12. That is, the voltage is applied to the thyristor 17 through the capacitor 19 to cause the conduction of the thyristor 17 to begin a voltage step-up oscillation. The oscillation continues if the capacitor 19 is not provided, but when the terminal voltage of the capacitor is raised by its charge so as to cancel the source voltage, the thyristor 17 becomes nonconductive. The process is repeated at each half cycle of the source voltage, and the circuit 18 generates an intermittent oscillation output at the fixed phase of each half cycle of the AC source 10. At this time, HF oscillating current flows through the closed circuit 18, and preheats the filaments 11. On sufficient preheating of the filaments 11, the lamp 13 starts its initial ignition by the oscillation output of the circuit 18.

The voltage, current, and light output wave forms of the circuit of FIG. 2 are shown in FIGS. 3(*a*) to (*c*). As indicated in FIG. 3(*a*), the intermittent oscillation voltage $V_R$ is applied to the lamp 3 so as to overlap the source voltage. The lamp 13 begins its discharge by the inducted conductivity due to the oscillation voltage $V_R$. After the initial ignition of the lamp 13, the lamp current $I_T$ as indicated in FIG. 3(*b*) flows through the choke 12. At this time, the oscillation of the circuit 18 ceases, but the duration of the intermittent input current $I_R$ continues until after the steep increase of the lamp current $I_T$. The suspension of the input current $I_R$ stops the oscillation of the circuit 18. Thus, the lamp 13 is reignited by the the cooperation of the oscillation voltage $V_R$ and the release of the electromagnetic energy accumulated in the choke due to the input current $I_R$ at each half cycle of the AC source, and the lamp lighting is maintained by the source voltage. Thus, the lamp voltage $V_T$ becomes a substantially rectangular wave form having a suspended period at the time of the intermittent oscillation, besides, the voltage $V_T$ is raised by the flow of the input current $I_R$ through the choke 12.

The lamp current $I_T$ generates a visual light emission or output almost proportional to the lamp current density as indicated in FIG. 3(*c*). As is clear from the wave form of the light emission output, the residual light output at the time of the very low lamp current is at a low level. However, the emergent phase of the input current $I_R$ is almost constant regardless of the change of the source voltage, accordingly the phase of the steeply increasing lamp current $I_T$ is also constant regardless of the source voltage change. Besides, the input current $I_R$ has a tendency to decrease, since it has a negative fluctuation coefficient due to the fact that a portion of the input current wave form encroaches upon the emergent phase of the input current $I_R$ of the next half cycle, when the lamp current $I_T$ increases as the source voltage becomes high. This fact means that the regulation of the lamp current can be maintained favorably in spite of the reduction of the stabilizing impedance.

In case of the above mentioned lamp lighting system, the lamp 13 is reignited in each half cycle of the source 10 by the intermittent oscillation output of the circuit 18 and the accumulated energy of the choke 12. Therefore, the above lamp lighting system is able to lower the source voltage, and the lamp voltage is able to increase up to about 1.4 times the source voltage in comparison with a conventional system wherein the lamp is reignited only by the source voltage. If both voltages are selected to be almost equal, the choke 12 supporting the ballast or balance voltage can be diminished remarkably. In fact, the ballast choke in FIG. 2 as compared with that of FIG. 1, can be reduced with regard to the accumulated energy and with regard to the required inductance respectively to an extent corresponding to about one fourth to one fifth of the size of the choke 12 in FIG. 1.

However, in the lamp lighting system of FIG. 2, the thyristor 17 becomes intermittently conductive short circuits and the circuit 18 relative to the low frequency component during the operational period of the intermittent oscillating circuit 18. Accordingly, the LF lamp current $I_T$ is lacking during this period, and only the faint relatively low or small HF current flows through the lamp 13. That is, the lamp current $I_T$ is not supplied to the lamp 13 during the oscillation period T, and an intermittent suspended period of the lamp lighting arises. This fact may cause a problem especially when this suspended period T is prolonged, the light output efficiency is decreased.

OBJECTS OF THE INVENTION

In view of the foregoing, it is the aim of the invention to achieve the following objects singly or in combination:

- to provide a discharge lamp lighting system to elevate the lamp light efficacy as well as the efficiency;
- to provide a novel and improved discharge lamp lighting device which attains an improved efficiency owing to the reduction of the ballast loss, and an elevated light efficacy due to the continuous lamp lighting;
- to provide a new and improved intermittent high frequency operating system for discharge lamps, in which the lamp wattage is converted to high frequency at the most suitable rate; and
- to provide a new and improved oscillating circuitry for supplying a high frequency component from a high frequency source to a load, as well as low frequency component from an AC source, wherein a matching impedance is added between the high frequency source and the AC source.

SUMMARY OF THE INVENTION

In accordance with the invention, there is provided a discharge lamp lighting device comprising a low frequency (LF) AC source, a current limiter, a discharge lamp coupled to the AC source through the current limiter, and a high frequency (HF) oscillating circuit connected in series to the discharge lamp, wherein overlapped LF and HF energy components are applied to the discharge lamp. The operation of the discharge lamp is performed by supplying an HF current converted from an LF current of the AC source and by applying a reignition voltage during a given period including an initial part of each half cycle of the AC source, whereby the lamp light is continuously emitted so as to improve the light efficacy. Preferably, there is provided an intermittent high frequency operating system for discharge lamps, which removes defects of a lighting pause which existed heretofore in each half cycle and which also removes a poor lamp current regulation present in the conventional every half cycle reignition system. The invention achieves this improvement by supplying the HF and the LH components for the lamp operation in an overlapping manner.

The every half cycle reignition system of the prior art utilizes both functions with regard to the high frequency high voltage and the intermediate frequency energy stored in the choke coil. One of the problems of said system is that the lamp hardly lights up during the operation of an intermittent oscillator, since the lamp is short-circuited by the low impedance of the oscillator. Another problem is the poor lamp current regulation, since the intermittent oscillation period is reduced as much as possible in order to obtain a longer light emitting period. In this connection, the intermittent high frequency operation of the discharge lamp of this invention aims at solving the above-described problems, wherein a lamp is short-circuited for the lower frequency but not for the high frequency, whereby a continuous light output is obtained by the high frequency current in the intermittent oscillation period in addition to the LF current. This raises the overall efficiency, and improves the regulation or control by a capability of increasing the oscillation. The present high frequency operation system raises the lamp efficacy more than several percents, however, it generates certain switching and operational losses, whereas the every half cycle reignition system is able to reduce ballast loss and cost, but the lamp efficacy is lower than that of the present high frequency operation system. In combination of these two systems, I have found that even if a light emission pause existed in each half cycle, the overall efficiency is as high as that of a transistor inverter system without DC smoothing since the lamp wattage is converted to high frequency at the most suitable rate, and the converted energy is supplied to the lamp during operation of the intermittent oscillator, so as to obtain both, an improvement of the light efficacy and of the current regulation.

According to another aspect of the invention, present discharge lamp lighting device comprises an oscillating circuit for converting the LF component of the AC source into an HF component and supplying its intermittent output to the lamp. Though a transistor inverter may be used as an oscillator, it is desirable to use a current driving oscillator having a wave shaping circuit to provide an output having a sine wave form of a distorted or deformed wave. Preferably, the supply duration of a continuous HF component supplied to the lamp is to be supplied in an initial part and for less than half the duration period of each half cycle of the AC source.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS OF THE BEST MODE OF THE INVENTION

Figure 4:
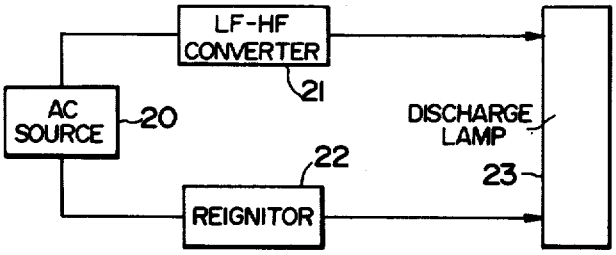
FIG. 4 is a block diagram explaining the basic concept of this invention.

The description of embodiments of the present invention will proceed referring to the drawings. FIG. 4 is a basic system diagram for explaining the concept of the invention by supplying the output of an AC source 20 to a low frequency-high frequency current converter 21 connected in series with a discharge lamp 23 and with a reignitor 22 respectively. The converter 21 converts low frequency (LF) current into a high frequency (HF) current. The converted HF component is applied to the lamp 23 by mixing or overlapping the LF component of the source. The reignitor 22 generates a high voltage applied to the lamp 23 for reigniting the lamp 23 at each half cycle of the source voltage. It has been found that HF lighting of the lamp 23 is attained by the overlapped currents of the HF and LF components to cooperatively elevate the lamp lighting efficacy.

Figure 1:
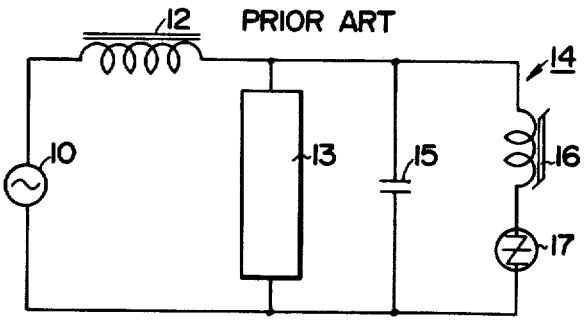
FIG. 1 is a circuit of a conventional discharge lamp lighting device using an electronic starter.
Figure 2:
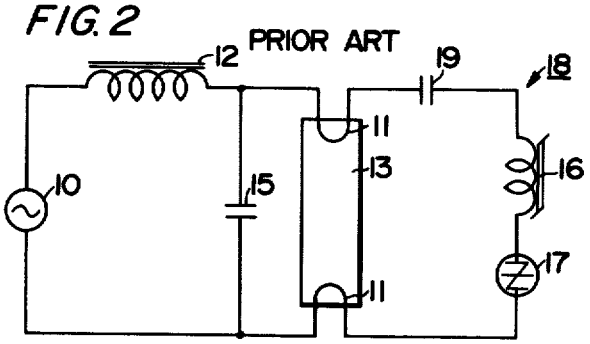
FIG. 2 is a circuit of another conventional discharge lamp lighting device of the "every half cycle ignited system" type.
Figure 5:
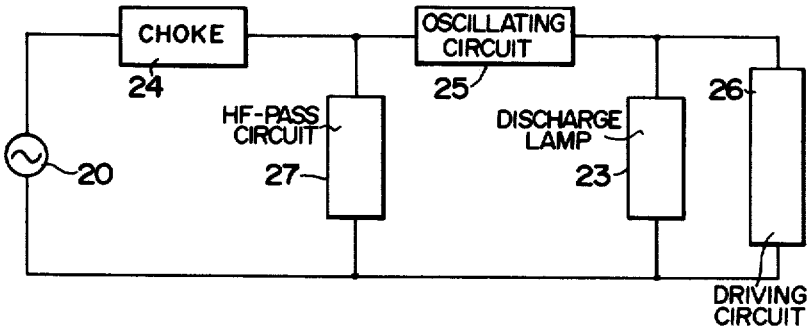
FIG. 5 is a basic block diagram showing a discharge lamp lighting device of an embodiment according to the invention.

FIG. 5 is a basic block diagram showing a lighting device of an embodiment according to the invention, which comprises an AC source 20, a ballast choke 24 as an impedance element, an oscillating circuit 25 as LF-HF converter means, a driving circuit 26 as a reignition means, and a high frequency (HF) pass circuit 27 connected as shown to the AC source 20 and to the discharge lamp 23. The driving circuit 26 is a circuit for generating an HF voltage when the oscillating circuit 25 is energized by the source 20. The intermittent oscillating circuit 18 of FIG. 2 may be used to embody the driving circuit 26, for example. The oscillating circuit 25 is a circuit for generating an HF current. The oscillating circuit 14 of FIG. 1 may be used as the circuit 25, for example. Although the ballast choke 24 functions to block the HF component, it may be used in connection with, for instance, a capacitor to form a phase advancer or a resistor. Besides, a constant current source or a DC source may be substituted for the AC source 20. Particularly, in FIG. 5 the choke 24, the oscillating circuit 25 and the lamp 23 are connected in series, and the HF pass circuit 27 is connected in parallel with the series circuit of the circuit 25 and the lamp 23. Here it is necessary to use the HF pass circuit 27 for shaping the wave form when the oscillating circuit 25 does not generate a sine wave oscillation but generates a distorted voltage.

In the operation of the circuit of FIG. 5, the voltage of the source 20 is applied to the oscillating circuit 25 and to the lamp 23. The oscillating circuit 25 converts the LF current of the source 20 to HF current. The envelope of the oscillation voltage generated by the oscillating circuit 25 is a wave form modulated by the AC source voltage. Because the oscillating circuit 25 is connected in series with the source 20 as far as the lamp 23 is concerned, the lamp 23 is operated by the overlapped voltage of the source voltage and by the HF oscillating voltage. The driving circuit 26 supplies to the lamp 23 the voltage necessary for the initial ignition and reignition thereof.

Figure 3:
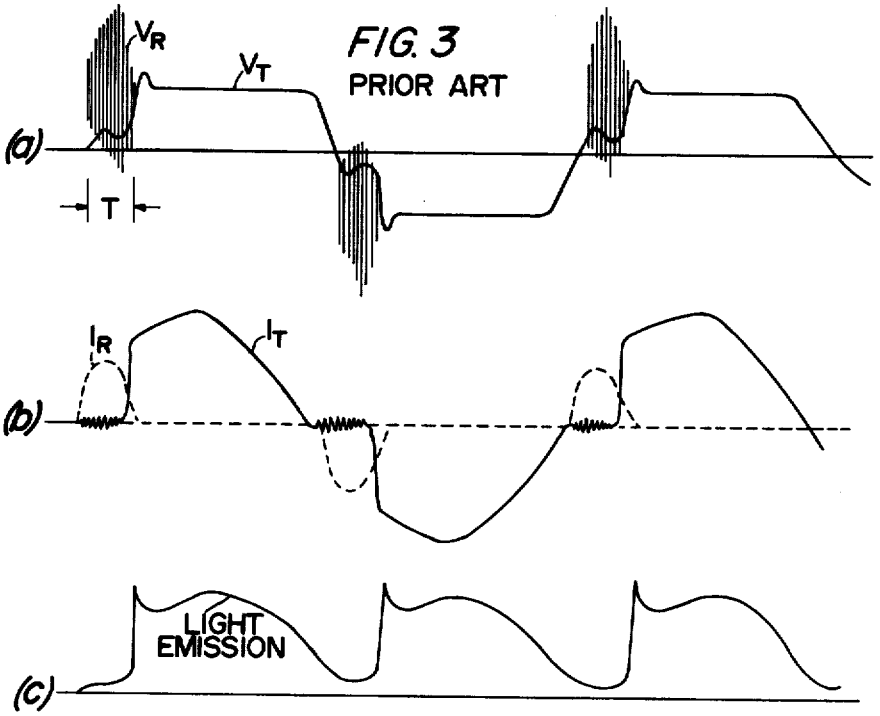
FIG. 3 PRIOR ART
FIG. 3 is a set of operation explanatory wave form of the circuit of FIG. 2.
Figure 6:
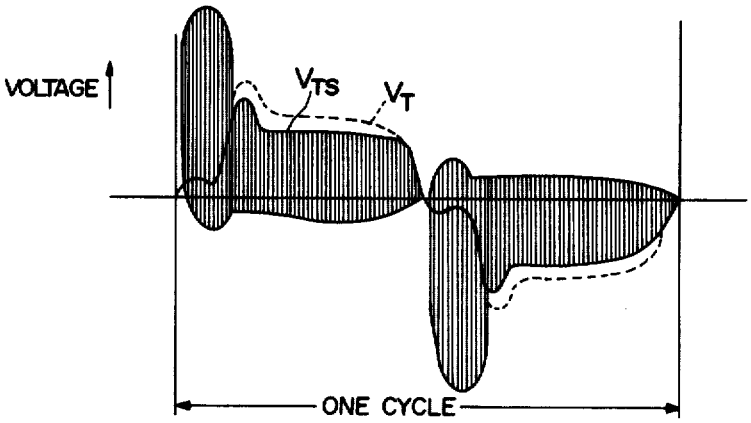
FIG. 6 shows wave forms for explaining the operation of the device of FIG. 5.

As shown in FIG. 6, the lamp voltage $V_{TS}$ of the lamp 23 is affected by the synthesized voltage of the lamp voltage $V_T$ of FIG. 3 and the above overlapped voltage. Consequently, the gas in the discharge lamp 23 is energized by the high frequency of the HF current. Accordingly, the cathode drop voltage is lowered, at the same time, the ultra-violet conversion efficiency of the positive column is elevated, and a high lighting efficacy of the lamp is obtained. After the lamp is ignited, the intermittent oscillation of the driving circuit 26 causes the HF current generated by the oscillating circuit 25 to flow into the lamp 23 to supplement the lacking portion of the light emission thereby contributing to improve the light efficacy. In other words, if the lamp 23 is lit according to this embodiment in accordance with the every half cycle ignited system, it is possible to obtain about 20% higher efficiency owing to the ballast loss reduction together with about 20% higher light efficacy owing to the HF lighting. Accordingly, the conversion efficiency of the present system is improved to the extent of about 40% higher as compared to the conventional lamp lighting system shown in FIG. 1. That is, the lamp lighting system of the present invention has remarkable advantages residing in the reduction of the ballast loss and in the improvement of the light efficacy.

Figure 7:
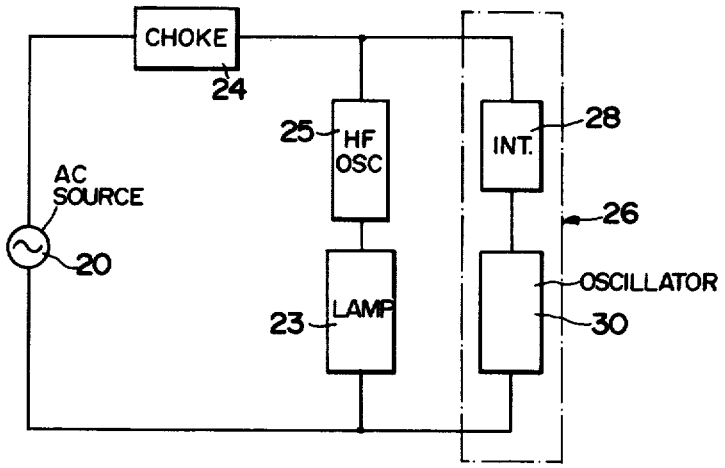
FIG. 7 is a block diagram of a modification of FIG. 5.

FIG. 7 is a modification of the device of FIG. 5. In FIG. 7 the driving circuit 26 is connected in parallel with a series circuit of the HF oscillating circuit 25 and the discharge lamp 23. Hereinafter, the same symbols are used for the same elements in order to omit the detailed description thereof. As for the operation of the circuit of FIG. 7, the oscillating circuit 25 is energized by the source 20 to cause oscillation and to generate the HF current only. Further, the driving circuit 26 which is similar to the intermittent oscillating circuit 18 of FIG. 2, comprises an oscillating circuit 30 and an intermittent circuit 28 such as an intermittent oscillation capacitor.

Figure 8:
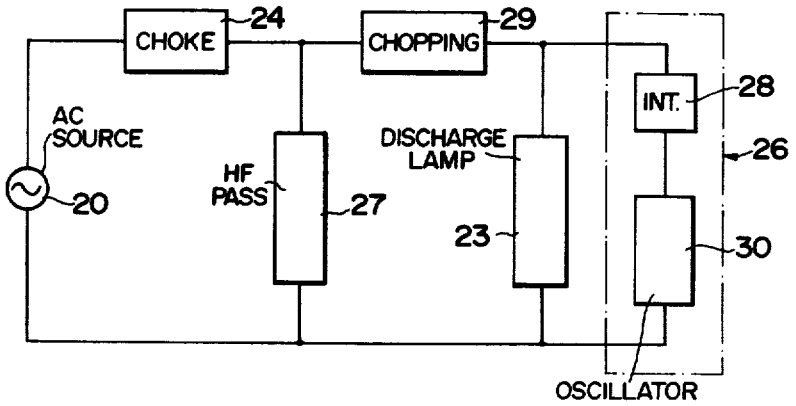
FIG. 8 is a block diagram of another modification of FIG. 5.

FIG. 8 is another modification of the circuit of FIG. 5, wherein a chopping circuit 29 is substituted for the HF oscillating circuit 25. The circuit 29 having switching means such as a transistor, thyristor or triac etc., generates a HF current by the succesive on-off switching of the source voltage. Besides, when the discharge lamp 23 is of a hot cathode type, the driving circuit 26 is also used as the preheating circuit of the filaments by the input current of the circuit 26 during the intermittent oscillation period at the time of the initial ignition of the lamp.

Figure 9:
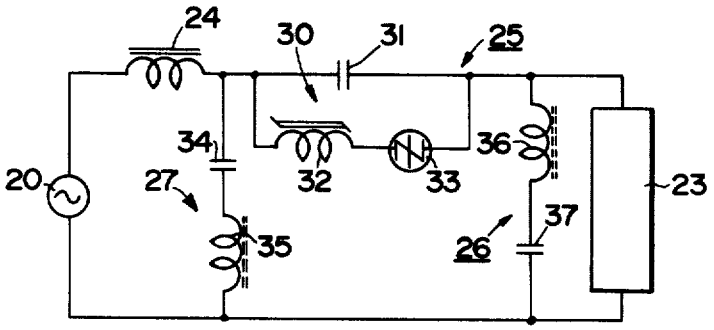
FIG. 9 is a circuit of an embodiment according to the invention.

FIG. 9 shows a lamp lighting circuit embodying the system of FIG. 5 of the present invention, wherein the lighting device comprises the AC source 20 of 100 V, 60 Hz, a choke 24 of 160 mH, an HF oscillating circuit 25, an HF pass circuit 27, a driving circuit 26 and the lamp 23 for example a 32-watt circular fluorescent type. The oscillating circuit 25 comprises an oscillation capacitor 31 of 0.033 μF and a series circuit of a nonlinear inductor 32 and a thyristor 33 (KIV-5 type) as a current control resistor element, connected in parallel with the capacitor 31. The nonlinear inductor 32 having similar characteristics as the nonlinear inductor 16 of FIG. 1, has an unsaturated inductance $Z_U$ of 110 mH and a saturated inductance $Z_S$ of 0.7 mH. The HF pass circuit 27 comprises a capacitor 34 of 0.01 μF and a wave shaping inductor 35 of 3.9 mH connected in series. The driving circuit 26 for the HF oscillating circuit 25 comprises an inductor 36 of 22 mH for blocking the HF component and a capacitor 37 of 1 μF connected in series, and the circuit is connected in parallel with the lamp 23. The inductor 36 acts as impedance against the HF high voltage generated by the HF oscillating circuit 25, and the capacitor 37 acts as an impedance against the LF voltage of the source.

In operation, when the source 20 is switched on, the LF current flows through the closed circuit of the choke 24—circuit 25—and circuit 26 to charge the oscillation capacitor 31. When the terminal voltage of the capacitor 31 exceeds the break-over voltage of the thyristor 33, the thyristor 33 becomes conductive, and the HF oscillation begins by the cooperation of the capacitor 31 and the inductor 32. The oscillation output of the HF current incresses as the input current increases. The generated HF voltage is blocked by both the choke 24 and by the inductor 36, but it passes through the HF pass circuit 27. While the LF voltage appears across the terminals of the capacitor 37, both an HF and an LF voltage may be applied to the lamp 23. Accordingly the lamp is initially ignited by the sum voltage of these HF and LF components. Further, a sawtooth wave form of the oscillating output voltage generated by the circuit 25 may be shaped by the wave shaping inductor 35 of the HF pass circuit 27.

Figure 10:
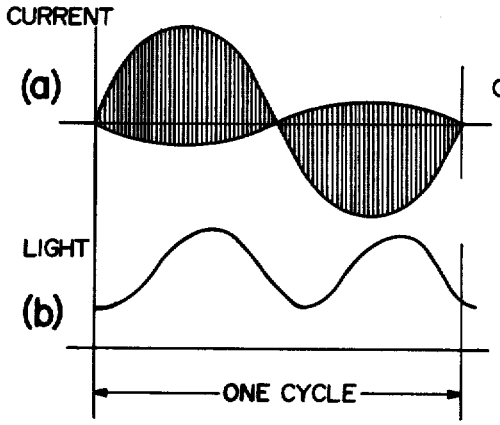
FIG. 10 is a set of wave form diagrams for explaining the operation of the circuit of FIG. 9.

The LF current from the AC source 20 flows in the lamp 23 through the choke 24 and the circuit 25, and continues the generation of the HF oscillating current 25. As shown in FIG. 10(*a*), in the operation of the discharge lamp 23 the LF and HF currents are overlapped. These currents provide a light emission as shown in FIG. 10(*b*). In this embodiment, the cooperation of the HF oscillating circuit 25 and the driving circuit 26 attains the function of the initial ignition reignition as described in FIG. 5. If another means is provided for the lamp ignition, the driving circuit 26 may become unnecessary, and it is possible to substitute an oscillating circuit merely having an HF generating function utilizing an inductor of an open magnetic circuit instead of the step-up type nonlinear inductor 32 for the HF oscillating circuit 25.

Figure 11:
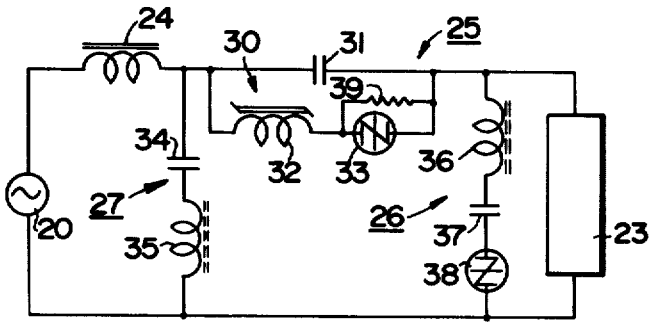
FIG. 11 is a circuit of another embodiment according to the invention.

FIG. 11 is a modification of FIG. 9, wherein the driving circuit 26 operates as a reigniting means and comprises a combination of a series circuit of an HF blocking inductor 36 and a capacitor 37 for an intermittent oscillation, and a newly added tryristor 38. Further, a resistor 39 of 15 KΩ for successive ignition is connected in parallel with the thyristor 33 of the HF oscillating circuit 25.

In operation, when the instantaneous value of the LF voltage exceeds the break-over voltage of the thyristor 38 when the AC source 20 is switched on, the thyristor 38 first becomes conductive. The capacitor 31 is charged by the LF current due to to the conductive state of the thyristor 38. When the terminal voltage of the oscillation capacitor 31 exceeds the break-over voltage of the thyristor 33, the thyristor 33 becomes again conductive. In response to the above condition, the oscillation capacitor 31 and the nonlinear inductor 32 cooperatively begin the oscillation. Thus, the generated HF voltage is blocked by the choke 24 and by the HF inductor 36 through the HF pass circuit 27. At the same time, the capacitor 37 for an intermittent oscillation is gradually charged by the LF current, and the LF voltage arises between the terminals of the capacitor 37. The sum voltage of the HF voltage and of the LF voltage is applied to the discharge lamp 23, and the lamp 23 is initially ignited by said sum voltage.

Then, the LF current flows in the lamp 23 through the ballast choke 24 and the oscillating circuit 25. Due to this condition, the oscillating circuit 25 continues its oscillation, and the HF current flows in the lamp 23 through the HF pass circuit 27. Accordingly, the overlapped HF current and the LF current flow in the discharge lamp 23 and the lamp is lit by the HF component. At this time, during the switching action of the thyristor 38, the capacitor 37 for intermittent oscillation is gradually charged to assume a charged state, and when the terminal voltage is elevated up to the fixed voltage, the thyristor 38 becomes nonconductive and stops the charge current. During the period from the time when the thyristor 38 becomes conductive to the time that the capacitor 37 is charged up to the fixed voltage, the HF high voltage is blocked by the inductor 36, and the HF high voltage is applied to the lamp 23. While the lamp 23 is reignited at every fixed phase including the part of the beginning of every phase of the source voltage by the intermittent HF high voltage generated by the cooperation of the HF oscillating circuit 25 and the driving circuit 26, the lamp lighting is maintained by the overlapped LF and HF currents.

Figure 12:
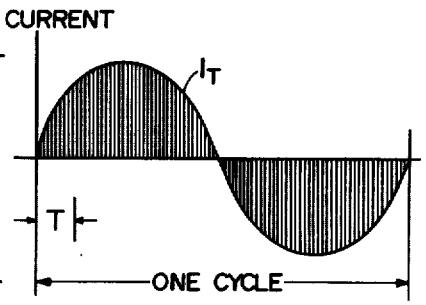
FIG. 12 is a wave form diagram for explaining the operation of the circuit of FIG. 11.

In other words, the oscillation of the oscillating circuit 25 causes the LF current to flow in the capacitor 37 through the inductor 36. The capacitor 37 is charged, and its terminal voltage cancels the source voltage. As the result, the thyristor 38 becomes nonconductive, and the oscillation of the HF oscillating circuit 25 ceases. Such action is repeated at each half cycle of the source 20, and the intermittent oscillation output is generated at the fixed phase of each half cycle. Since the intermittent oscillation output is blocked by the inductor 36, its output is applied to the lamp 23 together with the LF terminal voltage of the capacitor 37. The lamp lighting is maintained in the same manner as explained in the prior circuit of FIG. 2, by the cooperative action of the impression of the high voltage of the oscillation output and the release of energy accumulated in the choke by the intermittent input current. However, the lamp current $I_T$ in this embodiment becomes a continuous HF current as shown in FIG. 12. Thus $I_T$ differs from the characteristic of FIG. 10, but the effect is substantially the same.

As the inductor 36 is inserted between the HF oscillating circuit 25 and the capacitor 37, the impedance during the oscillation becomes large compared with the impedance of the choke 24. Differing from the intermittent oscillating circuit of FIG. 2 which forms the short-circuit condition during the intermittent oscillating operation, the requisite fixed voltage is applied to both ends of the lamp 23 even during the operation of the circuit 25. Accordingly, the lamp current $I_T$ of the lamp 23 flows for an effective lamp light emission, and the light efficacy is increased.

Figure 13:
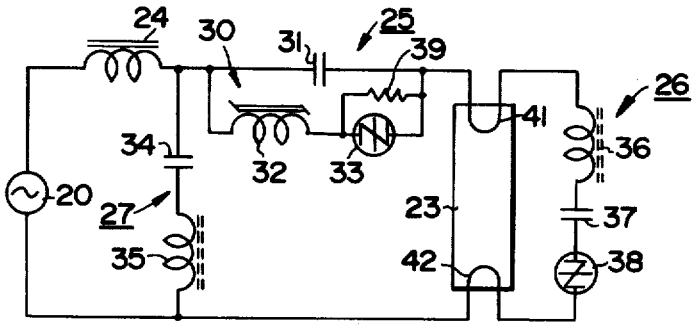
FIG. 13 is a circuit of a modification of FIG. 11.

FIG. 13 is a modification of FIG. 11, in which a 40-watt circular fluorescent lamp of the hot cathode type is used. At the side opposite the source, the filaments 41, 42 of the lamp 23 are connected with the driving circuit 26 comprising the series circuit of the inductor 36 of 22 mH, the capacitor 37 of 2.2 μF, and the KIV-5 type thyristor 38. Because the other construction of the device is the same as FIG. 11, the same portions are indicated by the same symbol, and a detailed description is omitted.

In operation, the lamp filaments 41 and 42 are preheated by the current flowing through the driving circuit 26. When a sufficient preheating of the filaments 41 and 42 is achieved, the lamp 23 begins its initial ignition by the intermittent HF oscillating voltage. After the initial ignition of the lamp, while the lamp 23 is reignited at each half cycle of the source 20 by the intermittent HF high voltage and by the release of energy accumulated in the choke by the driving current, the lamp lighting is maintained by the source voltage.

Figure 14:
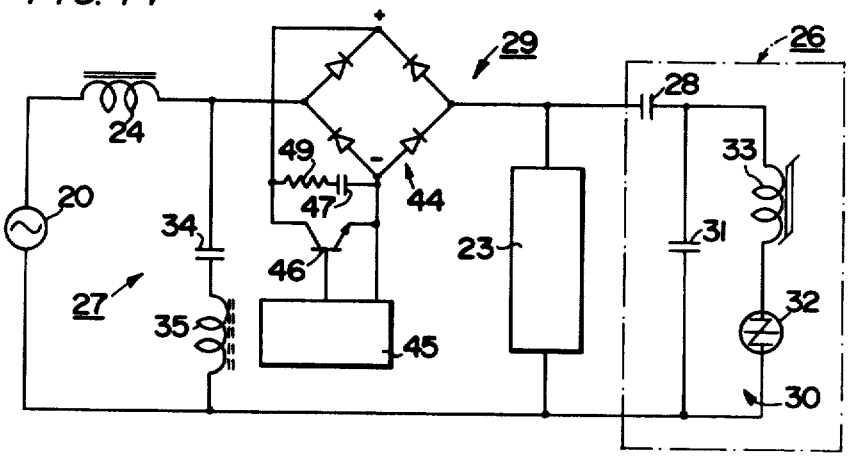
FIG. 14 is a circuit of an embodiment of FIG. 8.

FIG. 14 is a circuit embodiment of the discharge lamp lighting device as illustrated in the block diagram of FIG. 8, wherein the generation HF current and the high voltage are generated separately and applied to the discharge lamp 23. This circuit comprises a chopping circuit 29 which generates HF current, the driving circuit 26 for providing high voltage, and a discharge lamp 23. The driving circuit 26 is an intermittent oscillating circuit comprising the intermittent circuit 28 and the oscillating circuit 30 similar to that of the circuit of FIG. 2. The chopping circuit 29 comprises diodes 44 for a full wave rectification, a bias circuit 45, a transistor 46 which is driven by a biassing signal, and a series circuit of a capacitor 47 and a resistor 49 which is connected between the collector and the emitter of the transistor 46. This circuit 29 is coupled between the choke 24 and the lamp 23.

In operation, when the source 20 is switched on and when the bias circuit 45 supplies the biassing signal to the base of the transistor 46, the chopping circuit 29 begins generating the HF component. That is, the bias circuit 45 as a signal source generates HF pulses, and the transistor 46 causes a successive on-off switching action. Accordingly, the transistor 46 converts LF current supplied by the source 20 to HF current successively.

On the other hand, the driving circuit 26 generates a high voltage when the source 20 is switched on, and the HF component generated by the chopping circuit 29 is applied to the lamp 23 through the HF pass circuit 27 overlapped with the high voltage generated by the driving circuit 26, whereby, the lamp 23 is initially ignited. After the initial ignition of the lamp, the HF current generated by the chopping circuit 29 keeps the lamp in the lit condition. In case of the above, the reduction of the ballast impedance of the choke 24 is possible by selecting an adequate chopping frequency. Thus, it will be understood that the lamp 23 maintains the HF lighting with reignitions at the fixed phase point of each half cycle of the source voltage. Further, the chopping circuit 29 may be formed by the substitution of a gate turn-off thyristor for the transistor 46.

Figure 15:
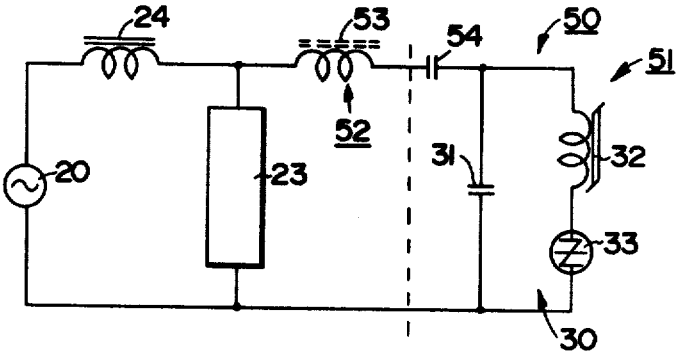
FIG. 15 is a circuit of a further embodiment according to the invention.

FIG. 15 shows another embodiment of the invention, wherein a supplying period of the HF component is limited to a certain portion of each half cycle of the LF component to attain an improvement of the lighting efficacy of the lamp. The circuit comprises an AC source 20 as an LF source, the discharge lamp 23 as a load circuit, an intermittent high voltage generating circuit 51 including an HF source 50, and a matching circuit 52 inserted between the lamp 23 and the HF source 50. The matching circuit 52 is, for instance, a high frequency HF inductor 53, and the sum value $Z_3$ of the impedance $Z_1$ of the inductor 53 and the impedance $Z_2$ of the lamp 23 is selected respectively to match the internal impedance $Z_S$ of the HF source 50. The matching of the internal impedance $Z_S$ of the HF source 50 and the external impedance $Z_3$ makes is possible for the HF source 50 to supply its maximum power to the lamp 23. Thus, even if the supplying period of the HF component to the lamp 23 is limited to a given portion of each half cycle of the LF component, the HF component is sufficiently supplied to the lamp by the addition of the matching circuit 52 in order to improve the light efficacy of the lamp.

Figure 16:
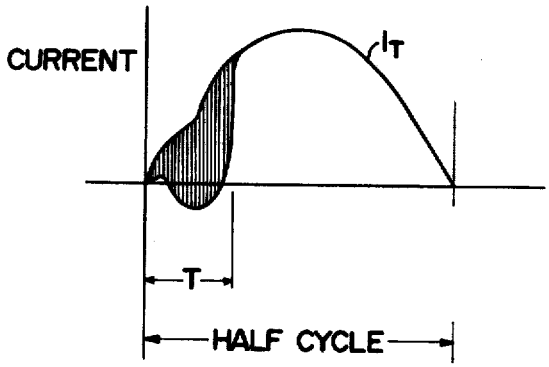
FIG. 16 is a wave form diagram for explaining the operation of FIG. 15.

In other words, the value of the impedance $Z_1$ of the matching inductor 53 is selected so that the sum impedance $Z_3$ of the impedance $Z_1$ and the impedance $Z_2$ coincides with the internal impedance $Z_S$ of the intermittent high voltage generating circuit 51 of the HF source 50. HF inductor 53 forms a resonance circuit together with an intermittent oscillation capacitor 54, and provides a resonance action regarding the oscillating circuit 30. That is, because of the resonance of the inductor 53 and the capacitor 54, the external impedance, namely the sum of the impedance $Z_1$ of the inductor 53 and the impedance $Z_2$ of the lamp 23, can be made equal with the internal impedance $Z_S$ of the intermittent high voltage generating circuit 51 so as to elevate its output voltage. Accordingly, the sufficient HF current can be supplied to the lamp 23 even during the intermittent oscillation period, and the lamp lighting efficacy is increased as shown in FIG. 16, wherein the period of supplying current is prolonged in comparison with a conventional lighting device. This period is selected to be several percent larger in each half cycle. Accordingly, even if the intermittent oscillation period is prolonged by increasing the capacity of the capacitor 54 for the intermittent oscillation, the HF current can be supplied to the lamp 23 sufficiently, and the regulation can be improved without any decrease in the lamp lighting efficacy.

Figure 17:
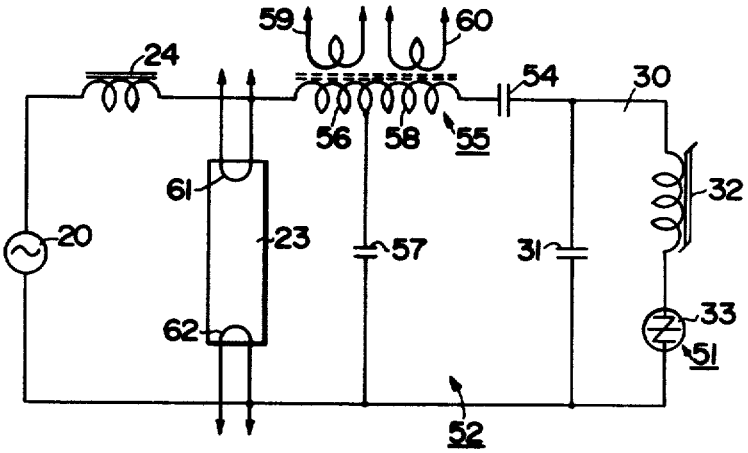
FIG. 17 is a circuit of a modification of FIG. 15.

FIG. 17 is a modification of FIG. 15, wherein a T-type circuit comprising a high frequency (HF) transformer 55 and a capacitor 57 are substituted for the HF inductor 53 of FIG. 15. The HF transformer 55 comprises a primary winding 56 of $N_1$ turns, a secondary winding 58 of $N_2$ turns, and filament windings 59, 60 in a magnetic coupling. The filaments 61, 62 of the hot cathode type discharge lamp 23 are preheated by the voltages inducted in the filament windings 59, 60. The winding ratio ($N_2/N_1$) of the HF transformer 55 is selected so that the internal impedance $Z_S$ of the intermittent high voltage generating circuit 51 coincides with the external impedance $Z_3$ including the lamp 23. That is, the internal impedance $Z_S$ of the intermittent high voltage generating circuit 51 and the external impedance $Z_3$ including the lamp 23 is made equal by selecting the winding ratio of the HF transformer 55 to elevate the intermittent oscillation output voltage. If the winding ratio of the HF transformer 55 is sufficiently large, a stepped-up intermittent oscillation output voltage is obtained, and the voltage for the initial ignition and reignition of the lamp 23 can be elevated.

Figure 18:
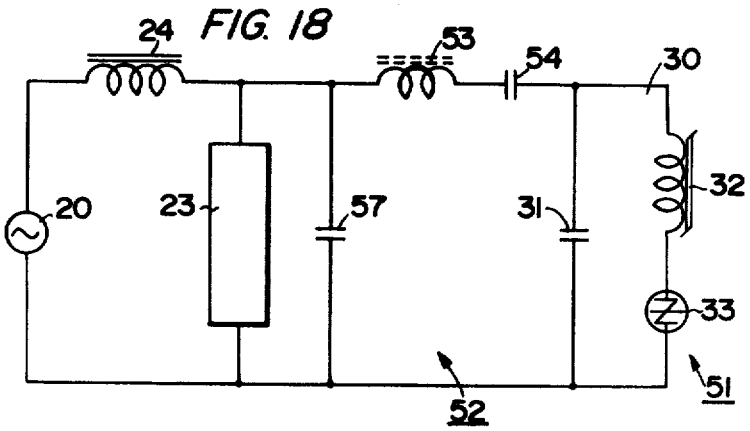
FIG. 18 is a circuit of a modification of FIG. 17.

FIG. 18 is a modification of FIG. 17, in which the matching circuit 52 is formed by a HF inductor 53 and a capacitor 57 in an L-type circuit. The inductor 53 and the capacitor 57 are selected so that the external impedance $Z_3$ including the inductor 53, the capacitor 57 and the lamp 23 coincides with the internal impedance $Z_S$ of the intermittent high voltage generating circuit 51 in the same manner as in FIG. 15, whereby the output voltage of the intermittent high voltage generating circuit 51 is increased. Further, if any magnetic leakage of the inductor 53 should exist, a tank circuit is formed by the magnetic leakage flux and the capacitor 57 to shape the pulse intermittent oscillation output voltage into a sine wave form for further improvement of the light efficacy of the lamp 23.

Though in the above example embodiments shown in FIGS. 15 to 18, discharge lamp lighting means embodying the invention are explained for achieving the initial ignition of the lamp and the reignition thereof by an every half cycle ignited system using the intermittent high voltage generating circuit as the HF source, the application of the present invention is not limited to the above, but can also be applied to a gas igniter and various other uses. Particularly, owing to the impedance matching means between the internal impedance of the HF source and the external impedance including the load, the maximum power of the HF source can be applied to the load. Accordingly the impedance matching means can be used very effectively for various purposes.

As described in the above examples according to the present invention, the LF source and the HF source are connected in series relative to the discharge lamp to provide an overlapped voltage from both sources for application to the discharge lamp. Therefore, initial ignition of the discharge lamp becomes easy and it also improves the lamp lighting efficacy. Here, the supply of HF current during the whole period of each half cycle of LF component is not always necessary, but the supplying period may be extended over several percents so as to reduce any energy conversion loss. Because the lack of a lighting emission at the time of reignition is avoided, it has been made possible to attain a still further improvement of the lamp lighting efficacy. Besides, the particularly favorable effects are obtained that the ballast size is diminished and a resulting reduction of the ballast loss is attained which improves the ballast efficiency as well as the total efficiency of the device. Although the invention has been described with reference to specific example embodiments it will be appreciated that it is intended to cover all modifications and equivalents within the scope of the appended claims.

What is claimed is:

1. An operating circuit system for discharge lamp means in a lighting device energized by a low frequency AC source, comprising frequency conversion means providing a high frequency power supply connected in series with said AC source for converting a low frequency current from said AC source into a high frequency current for energizing said lamp means by supplying said high frequency current to said lamp means, and reignition means connected for applying a reignition voltage to said lamp means for reignition of said lamp means during a given period including an initial part of each half cycle of said AC source, whereby a low frequency voltage component and a high frequency voltage component are applied in an overlapping relationship to said lamp means for continuously emitting light with an improved light efficacy, said system further comprising an inductive choke (24) operatively connected in said circuit system for limiting the current of said low frequency voltage component supplied to said discharge lamp means, and a high frequency pass circuit operatively connected in said circuit system for supplying said high frequency voltage component to said discharge lamp in each half cycle of said AC source during the entire lit condition of said discharge lamp means, said high frequency pass circuit avoiding said inductive current limiting means as an impedance for said high frequency voltage component, whereby said high frequency power supply becomes the primary power supply.

2. The system of claim 1, wherein said frequency conversion means comprises a high frequency current generating means connected in series with said AC source for energizing by said AC source for producing said high frequency current, and a high voltage generating means for producing a high voltage for said reignition.

3. The system of claim 1, wherein said frequency conversion means comprises a single oscillation circuit, formed by an oscillating circuit including an oscillation capacitor and a series circuit of a nonlinear inductor and a current controlled nonlinear resistor element, said series circuit being connected across said oscillation capacitor.

4. The system of claim 1, wherein said reignition means perform intermittently at each initial part in each half cycle of said AC source.

5. A discharge lamp lighting device, comprising a low frequency LF source, current limiting means, high frequency generating means connected in series with said LF source through said current limiting means for providing an HF voltage component, and discharge lamp means connected in series to said LF source and to said high frequency generating means whereby an LF voltage component from said LF source and said HF voltage component from said high frequency generating means are supplied in an overlapping manner to said lamp means and wherein said current limiting means comprise an inductive choke (24), said high frequency generating means including a high frequency pass circuit (27) for supplying said HF voltage component to said lamp means, said supplying of said HF voltage being unimpeded by said inductive choke (24) during the entire lit condition of said discharge lamp means.

6. The lighting device of claim 5, wherein said high frequency generating means generates said HF voltage component as an HF high voltage component at a time for an initial ignition of said lamp means.

7. The lighting device of claim 5, wherein said high frequency generating means include an intermittent oscillating means to produce an intermittent oscillation in each half cycle of said LF source, after initial ignition of said lamp means.

8. The lighting device of claim 7, wherein said intermittent oscillating means causes the flow of HF current into said discharge lamp during operation of said intermittent oscillating means.

9. The lighting device of claim 5, wherein said high frequency generating means comprise a rectifying means connected to said LF source and a chopper circuit (29) connected to be energized by rectified current from said rectifying means, whereby lamp currents to said lamp means comprise an overlapped current including a rectified current and a high frequency current passing through said high frequency pass circuit.

10. An oscillating circuit, comprising a low frequency AC source, a high frequency source connected in series to said low frequency AC source for energization by said AC source to produce a high frequency high voltage output, loading means operatively connected to said output and energized by said AC source and said high frequency source, and impedance matching means operatively interposed between said high frequency source and said loading means, wherein said impedance matching means has an impedance selected for matching an external impedance including said loading means to an internal impedance of said high frequency source, said impedance matching means having such an impedance that the maximum power is supplied from said high frequency source to said loading means.

11. The circuit of claim 10, wherein said impedance matching means comprises a high frequency inductor.

12. The circuit of claim 10, wherein said impedance matching means comprises a T-shaped circuit having at least a high frequency inductor.

13. The circuit of claim 10, wherein said impedance matching means comprises an L-shaped circuit having at least a high frequency inductor.

14. The circuit of claim 10, wherein said impedance matching means comprises a transformer having a primary winding and a secondary winding.

15. The circuit of claim 10, wherein said loading means is a discharge lamp.

16. The circuit of claim 15, wherein said high frequency source generates a high frequency high voltage intermittent output in each half cycle of said AC source.

* * * * *